US005146719A

United States Patent [19]

Saito et al.

[11] Patent Number: 5,146,719

[45] Date of Patent: Sep. 15, 1992

[54] SPACE TENSION CHORD ARCH DOME REINFORCED WITH TENSION MEMBERS AND METHOD FOR BUILDING SAME

[75] Inventors: Masao Saito, 4-11-13 Harayma, Urawa-shi Saitama; Shigeru Ban, Tokyo; Yoshio Takita, Tokyo; Yoshiki Mihara, Tokyo; Shinichi Takahashi, Tokyo, all of Japan

[73] Assignees: Masao Saito, Saitama; Kajima Corporation, Tokyo, both of Japan

[21] Appl. No.: 654,201

[22] Filed: Feb. 12, 1991

[30] Foreign Application Priority Data

Feb. 16, 1990 [JP] Japan ..... 2-35696

[51] Int. Cl.[5] ..... E04B 1/18

[52] U.S. Cl. ..... 52/80; 52/81; 52/DIG. 10

[58] Field of Search ..... 52/80, 81, DIG. 10

[56] References Cited

U.S. PATENT DOCUMENTS 3,330,201 7/1967 Mouton, Jr. ..... 52/80

*Primary Examiner*—David A. Scherbel
*Assistant Examiner*—Wynn E. Wood
*Attorney, Agent, or Firm*—James H. Tilberry

[57] ABSTRACT

A space tension chord arch member dome reinforced with tension members and method of construction. Maximum building space is ensured by using tension chord members, which reduces the material costs and simplifies assembly of the dome. The system permits use of laminated wood for the arch members of the dome superstructure.

8 Claims, 6 Drawing Sheets

SPACE TENSION CHORD ARCH DOME REINFORCED WITH TENSION MEMBERS AND METHOD FOR BUILDING SAME

BACKGROUND OF THE INVENTION

1. Field of the Invention

The field of invention relates to domed buildings and the method of assembling and erecting domed buildings.

2. Description of the Prior Art

In general, a space arch or a space truss dome is far superior as a structural system for building a large span structure, and, therefore, it is in wide use for the construction of large buildings such as gymnasiums and sports arenas. Conventionally, this type of structure is built by constructing a plurality of single truss members consisting of welded steel pipes or the like in three-dimensional configurations, such as disclosed in U.S. Pat. No. 3,330,201 to W. J. Mouton, Jr. The construction of such a structure requires a large number of single members, as well as substantial labor. Further, when a large span dome is built only with radial arch members, the section of each arch member must be substantially enlarged, so that not only is the material cost increased, but also the building space that it occupies is restricted.

The means for assembling steel pipe type trusses for a conventional dome is generally complicated, as is the analysis of stress of such trusses. On the other hand, while wooden arch domes utilizing wooden materials have been widely built, the scale of such arch domes formed only with wooden materials has been limited.

SUMMARY OF THE INVENTION

A space tension chord arch dome reinforced with tension members according to the preferred embodiment of the present invention is characterized in that a plurality of wooden arch members are positioned radially between the top of the arch dome and the dome foundation; a plurality of spreader members are secured to the respective arch members so as to diverge from both sides of the arch members in an inverted V-like configuration; a plurality of tension chord members extend in the longitudinal direction of the arch members and in the circumferential direction of the dome to interconnect both upper and lower ends of the arch members and the lower ends of the spreader members, and also interconnect the lower ends of adjacent spreader members.

A method for building a space tension chord arch dome reinforced with tension members according to the present invention comprises the steps of assembling arch members, spreader members, diagonal cables and ring cables at the ground level of the dome structure, gradually lifting assembled arch members and positioning them in place to form the superstructure of the dome, and then fixing the respective connections of the arch members, the spreader members, the diagonal cables and the ring cables.

According to this assembly method, tension chord members having small cross sections, such as wire rope, are used for all members other than the arch members. Maximum building space is ensured, since a large number of single members consisting of steel pipes or the like, as used in the prior art, are not needed. Therefore, the calculation of stress, as well as the erection of the dome, is simplified, and the cost of erection is reduced.

In the inventive wooden arch, the texture of the arch member is shown to the maximum, while easily permitting a large projection of wooden span.

Furthermore, since cross members for interconnecting adjacent arch members therebetween are not used, roofing cover, such as plastic, is easily applied on the top surfaces of the arch members.

OBJECTS OF THE INVENTION

It is among the objects of the present invention to provide a space tension chord arch dome reinforced with tension members and its method of erection, in which the maximum building space is ensured by using tension chord members wherein there is a reduction of material cost; simplification of the construction of the dome; and use of wooden structural supporting spans.

BRIEF DESCRIPTION OF THE DRAWINGS

The foregoing and other objects and features the invention will become apparent from the following description of a preferred embodiment of the invention, with reference to the accompanying drawings, in which.

DETAILED DESCRIPTION OF PREFERRED EMBODIMENT

Figure 1:
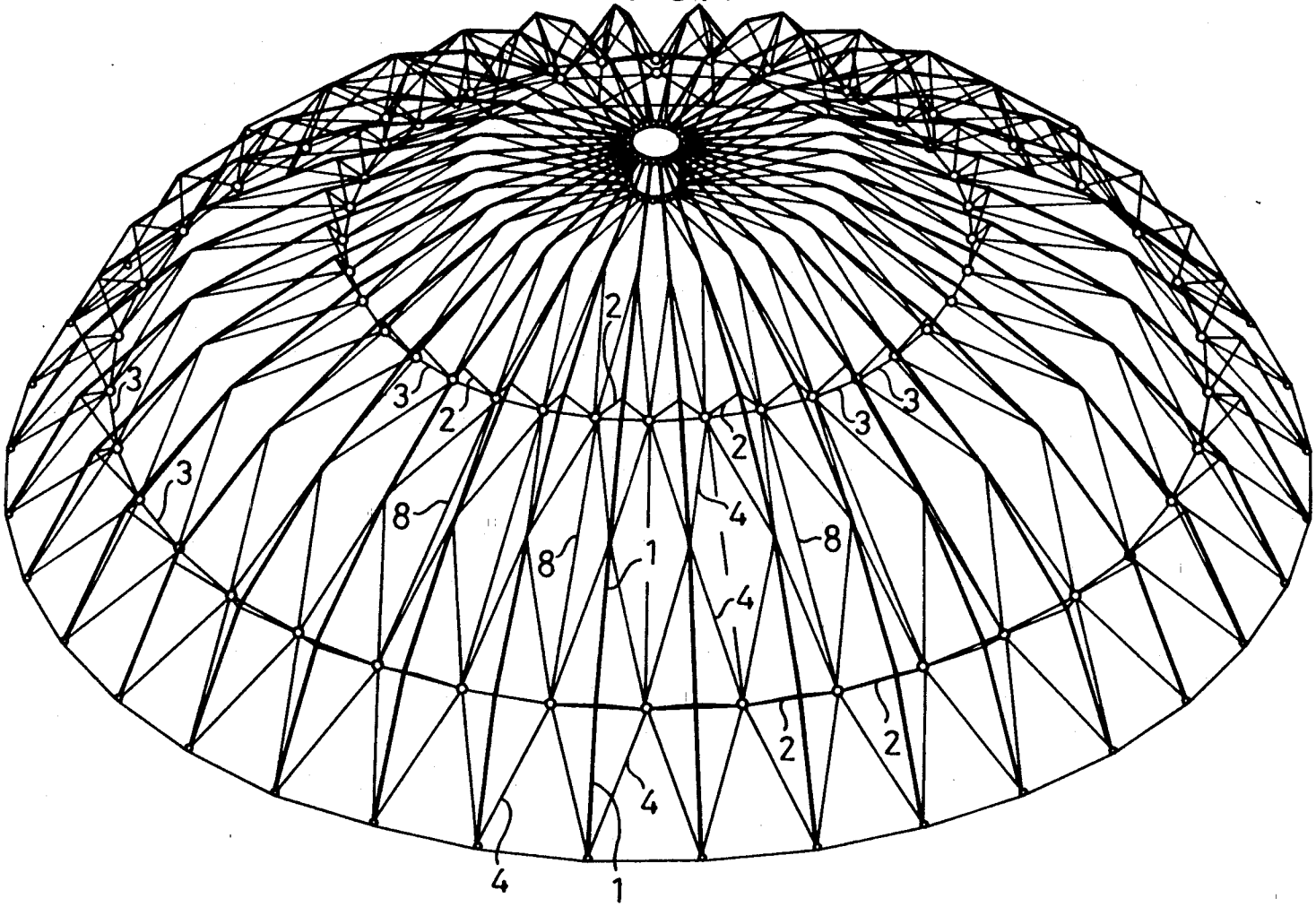
FIG. 1 is a perspective elevational view showing the inventive space tension chord arch dome.
Figure 2:
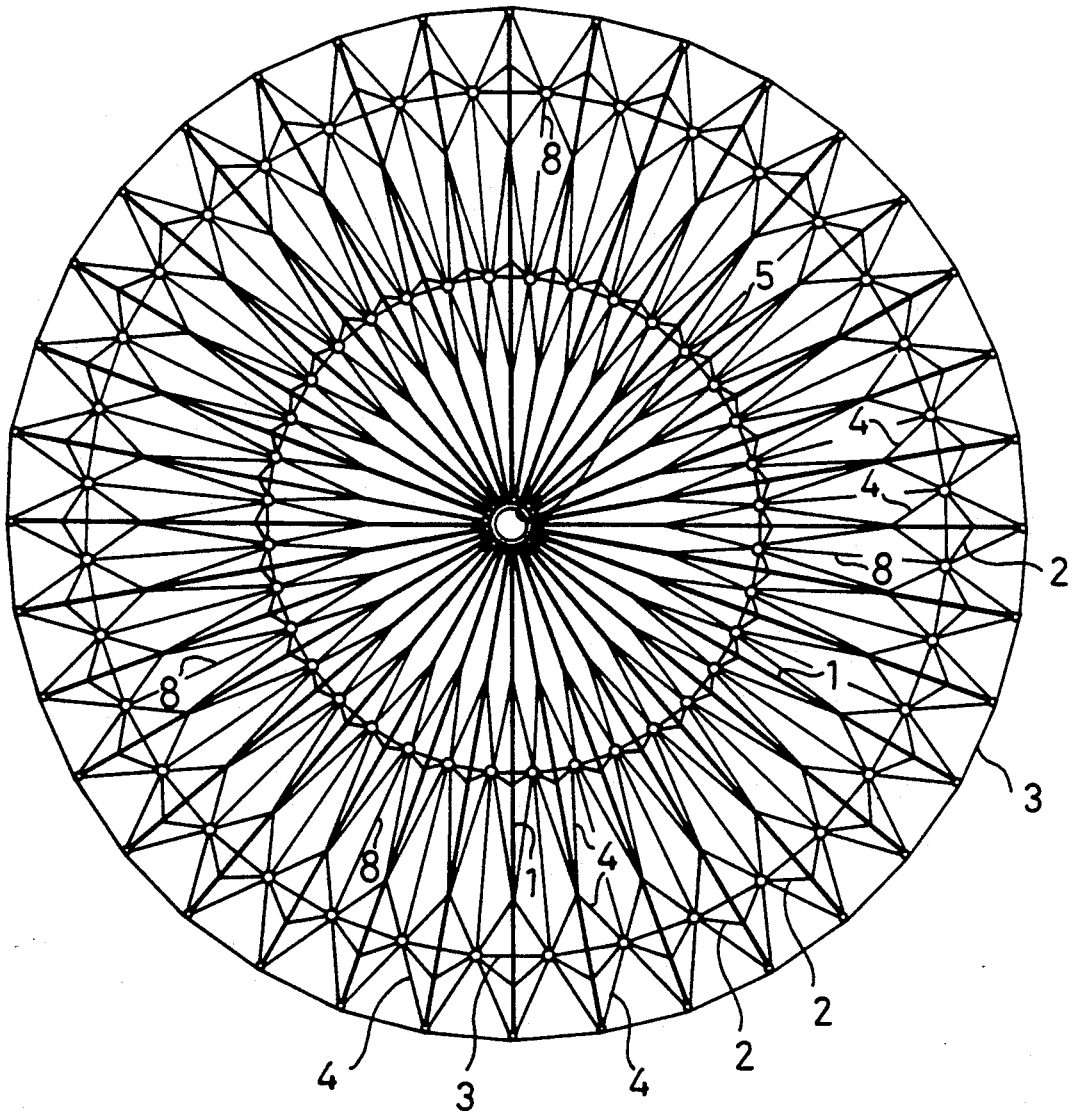
FIG. 2 is a plan view of the dome shown in FIG. 1.
Figure 3:
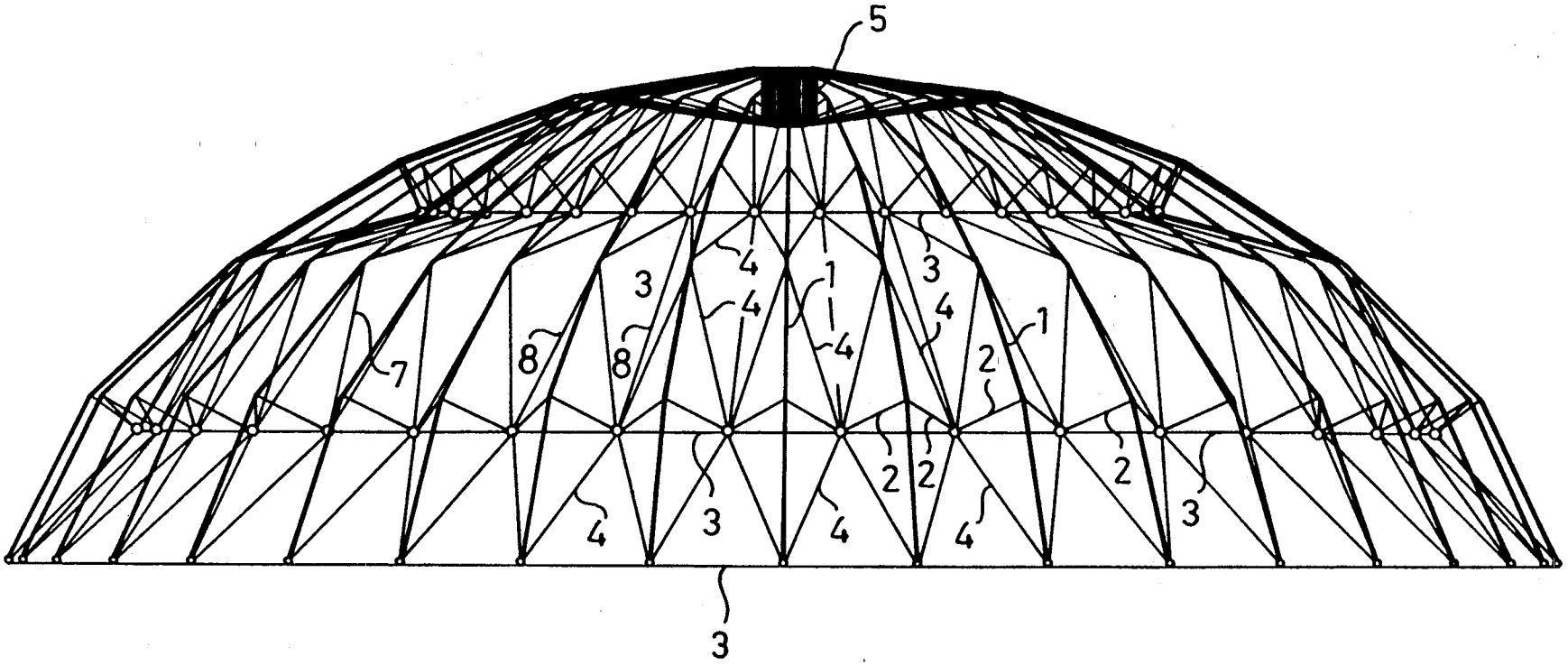
FIG. 3 is a side elevational view of the dome shown in FIG. 1.
Figure 4:
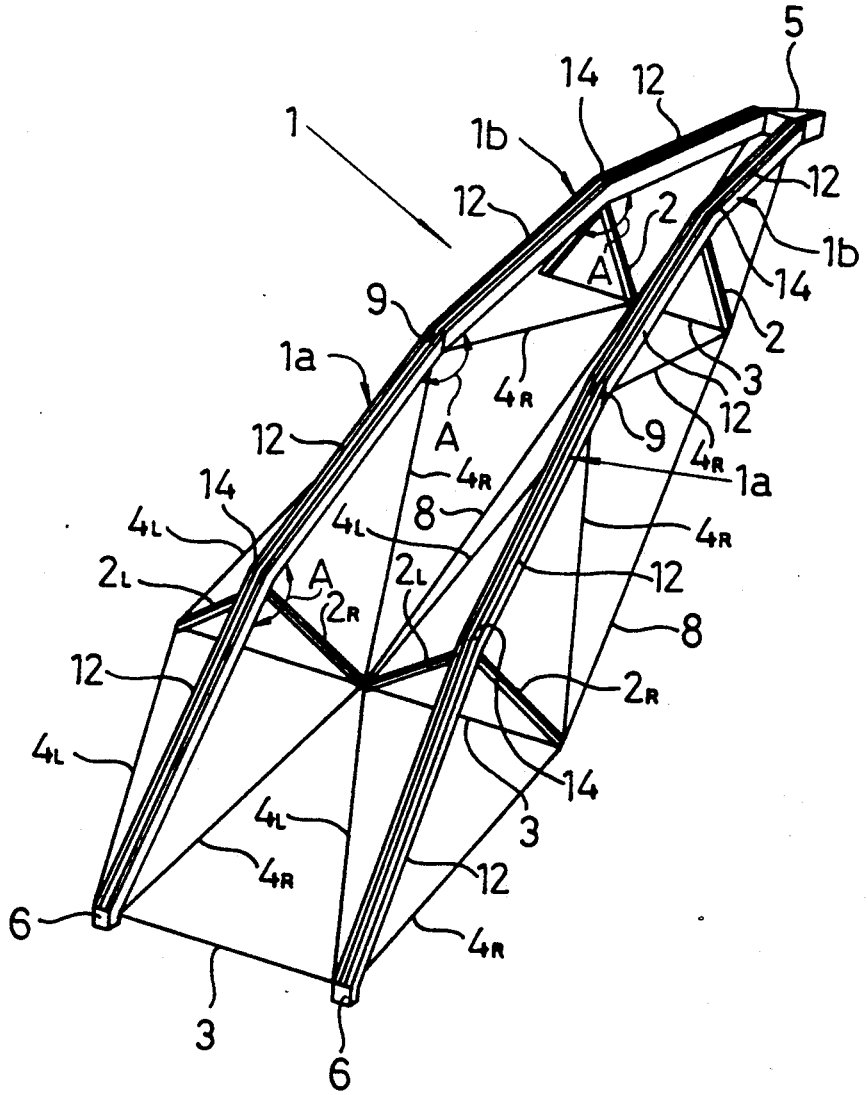
FIG. 4 is a fragmentary enlarged-scale perspective view showing a pair of segmented wooden spans used in a preferred embodiment of the invention.
Figure 5:
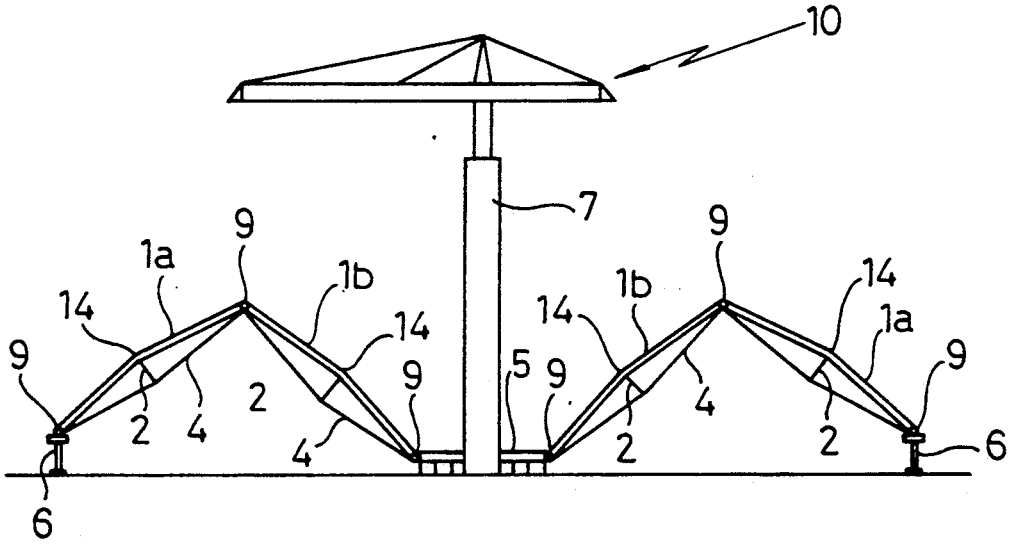
FIG. 5 is a schematic elevational view of the start of the erection of the dome spans.
Figure 6:
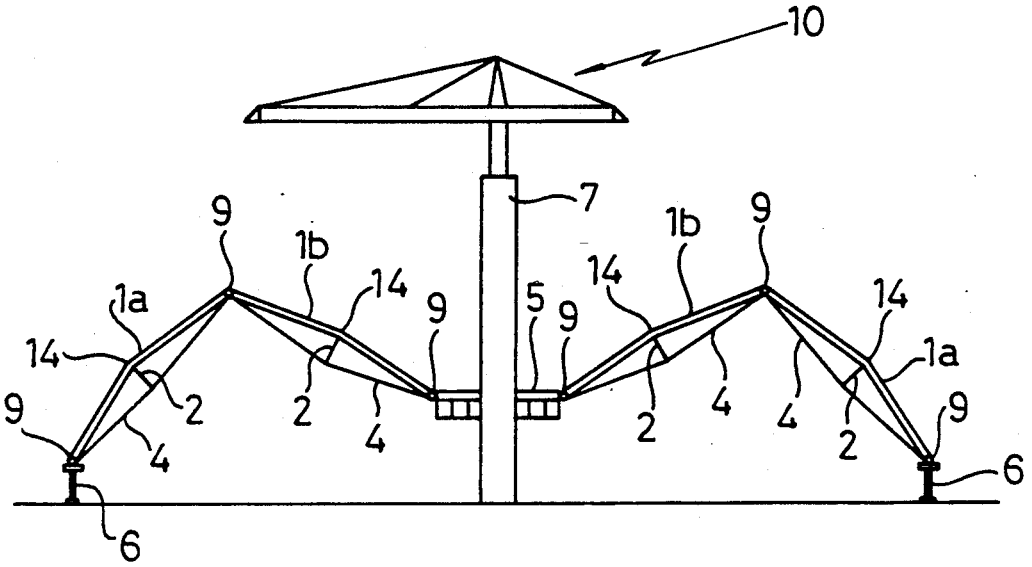
FIG. 6 is a schematic elevational view of a lower intermediate position of the erection of the dome spans.
Figure 7:
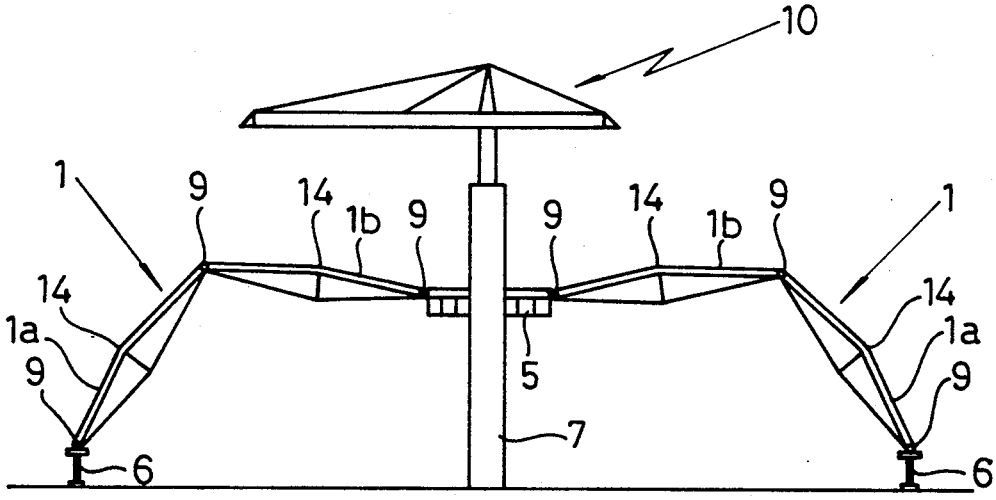
FIG. 7 is a schematic elevational view of an upper intermediate position of the erection of the dome spans.

FIGS. 1 through 3 are general views of a space tension chord arch dome reinforced with tension members according to the present invention, and FIG. 4 shows the basic structural arch units of such an arch dome. As best shown in FIG. 4, reference numeral 1 designates arch members; numeral 2 designates the spreaders; numeral 3 designates the ring cables; numeral 4 designates the diamond-configured cables; numeral 5 designates a compression ring; and numeral 6 designates lower foundation members. The arch member 1 is composed of both a lower sub-arch member 1*a* and an upper sub-arch member 1*b*, which are secured together in the approximate center of the arch member 1 with suitable prior art hinge action type fasteners 9, as shown in FIGS. 5 through 8.

The lower and upper sub-arch members 1*a*, 1*b* of the arch member 1 are formed of glued laminated wood having a predetermined shape, such as shown in FIG. 4. A lower end of each lower sub-arch member 1*a* and an upper end of each upper sub-arch member 1*b* are respectively connected to the lower foundation member 6 and the compression ring 5 with the aforementioned hinge action type fasteners 9. Therefore, the lower and upper sub-arch members 1*a*, 1*b* are adapted to continuously hingedly adjust to the required angularity between foundation member 6 and the compression ring 5, as the upper end of sub-arch member 1*b* is raised with compression ring 5 on the center column 7 of the crane 10, as shown in FIGS. 5 through 8.

Pairs of diamond cable spreaders 2 are respectively secured to the approximate centers of the lower and upper sub-arch members 1*a*, 1*b*, so as to gradually diverge downwardly from both sides of these members in an inverted V-like configuration. The respective lower ends of the diamond cable spreaders 2 are connected to the lower ends of adjacent diamond spreaders 2, respectively suspended from the centers of adjacent lower and upper sub-arch members 1*a*, 1*b*.

Accordingly, the diamond cable spreaders 2 combine to form a continuous corrugate ring circumferentially about the arch dome. The ring cable 3 is also installed in a continuous circular form to circumferentially encircle the arch dome. The lower ends of the diamond cable spreaders 2 are interconnected with the ring cable 3 in such a manner that the ring cable 3 may freely rotate relative to the lower ends of the diamond cable spreaders 2.

Figure 8:
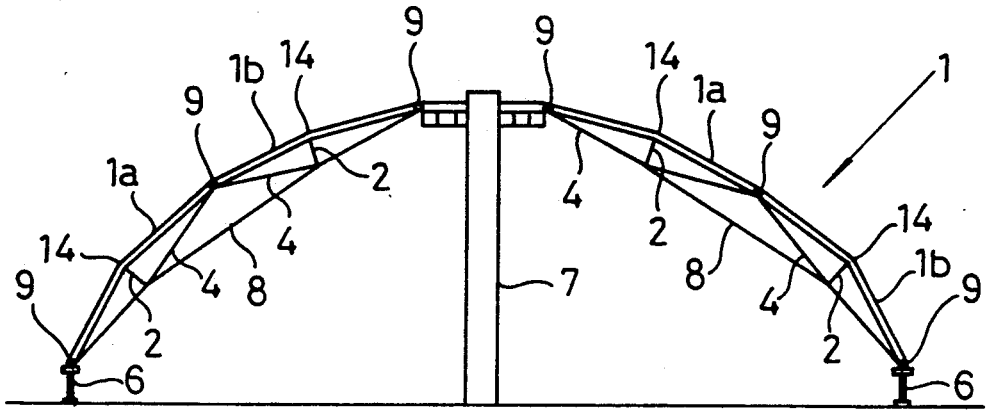
FIG. 8 is a schematic elevational view of the dome spans fully elevated and in place to form one complete span of the dome.

Cables 4L and 4R, FIG. 4, are strung in a diamond-shaped configuration beneath sub-arch members 1*a* and 1*b*. The lower ends of cables 4L and 4R beneath sub-arch members 1*a* are joined together at the lower end of sub-arch member 1*a* and extend to the lower extremities of diamond cable spreaders 2L and 2R, respectively. From there, cables 4L and 4R are rejoined at the upper end of sub-arch member 1*a* to complete the diamond configuration. A second set of cables 4L and 4R subtend sub-arch member 1*b* in the same diamond configuration just described with respect to sub-arch member 1*a*. Sub-arch members 1*a* and 1*b*, when in place as best shown in FIG. 8, are interconnected by cables 8, which complete the assembly of the sub-arch members 1. Cables 8 also prevent the tension of ring cable 3 from being loosened in the event of a strong wind and/or unevenly distributed snow.

In the preferred embodiment of the invention shown in FIG. 4, sub-arch members 1*a* and 1*b* have the same dimensions, and therefore are interchangeable for assembly purposes. The sub-arch members are fabricated from laminated wood, and each comprises a pair of straight legs 12 of equal length which meet at juncture 14 to form an obtuse angle A of approximately 170°, as shown in FIGS. 5 through 8. Sub-arches 1*a* and 1*b* are hingedly connected at 9, and, when in the erected position shown in FIG. 4, also form an obtuse angle A of approximately 170°. Arch 1 therefore is comprised of four legs 12 of equal length joined to form three equal angles A which define the arcuate curvature of the dome superstructure.

The compression ring 5 is also formed of a laminated wood material into a circular ring-like shape with a predetermined radius. The lower foundation member 6 is mainly formed of reinforced concrete or steel framed reinforced concrete. Cables 3 and 4 may be formed from small diameter wire rope or steel rod. The arch member 1, the diamond cable spreaders 2, and the compression ring 5 serve as compression members against external forces, and the ring cables 3 and the diamond-configured cables 4 serve as tension members. The diamond cable spreaders 2 largely serve as a buckling prevention member of the arch member 1.

After the lower foundation members 6 are in place, the arch members 1, the diamond spreaders 2, the ring cables 3, the diamond-configured cables 4, and the compression ring 5 are assembled on the ground level of the dome erection site. These members are connected to each other mainly by the use of standard fastening means in a manner to permit some movement and adjustment between members while still on the ground. A tower crane 10 is erected in the center of the dome site for the erection of the arch members 1. The compression ring 5 encircles the center post 7 of the crane 10 and is hoisted together with the upper ends of sub-arch members 1*b* while the lower ends of sub-arch members 1*a* are secured, for arcuate movement, to foundation members 6. When the compression ring 5 reaches the top of the crane center post 7, the hinge type fasteners are tightened and cables 8, FIG. 8, are set in place to stabilize each arch member 1. After all arch members 1 are set in place by this method, the shell of the dome is complete and ready for a fabric or plastic roof covering, as may be required. A film member such as Teflon glass fiber cloth may be used for this purpose.

The specification and drawings disclose a preferred embodiment of the invention. However, various features, details and elements may be changed or eliminated without departing from the invention as defined in the accompanying claims.

What is claimed is:

1. A tension chord reinforced arched dome comprising: a first sub-arch member having upper and lower ends; a first pair of spreader means having near and remote ends, said near ends being secured to the midpoint of said first sub-arch member; said first pair of spreader means extending normally downwardly and diverging laterally away from said sub-arch member in equal and opposite directions; and first cable means connecting said first spreader means remote ends to said first sub-arch member upper and lower ends; a second sub-arch member having upper and lower ends; a second pair of spreader means having near and remote ends, said near ends being secured to the midpoint of said second sub-arch member, said second pair of spreader means extending normally downwardly and diverging laterally away from said sub-arch means in equal and opposite directions; second cable means connecting said second spreader means remote ends to said second sub-arch member upper and lower ends, and means to hingedly secure said first sub-arch member to said second sub-arch member.

2. The tension chord reinforced arched dome of claim 1, wherein each of said sub-arch members comprises two straight legs of equal length rigidly joined in linear abutting relationship to form a predetermined angle therebetween and therebeneath; said first and second sub-arch members being hingedly secured together in linear abutting relationship to form said predetermined angle therebetween, whereby said arch member is formed of said four legs with equal angles therebetween to define a uniformly arcuate truss; a circular foundation member; a compression ring positioned at the center of and vertically above said circular foundation member; said uniformly arcuate truss extending from said circular foundation member to said compression ring.

3. The tension chord reinforced arched dome of claim 2, wherein said sub-arch members are fabricated from laminated wood.

4. The tension chord reinforced arched dome of claim 1, comprising: dome foundation means; a dome compression ring; means to hingedly connect the said upper end of said first sub-arch member to the said lower end of said second sub-arch member; means to hingedly connect the said lower end of said first sub-arch member to said dome foundation means; means to hingedly connect said upper end of said second sub-arch member to said dome compression ring; means to hoist said dome compression ring until said first and second sub-arch members define a continuous uniform arcuate arch between said foundation member and said dome compression ring; and cable means to secure the said remote ends of said first pair of spreader means to the remote ends of said second pair of spreader means.

5. The tension chord reinforced dome of claim 4, including a plurality of said hingedly connected first and second sub-arch members radially arrayed and hingedly connected between said dome compression ring and said foundation means.

6. A tension chord reinforced arched dome comprising: a first sub-arch member having upper and lower ends; a second sub-arch member having upper and lower ends; means to hingedly secure the upper end of said first sub-arch member to the lower end of said second sub-arch member; a dome compression ring; means to hingedly secure the upper end of said second sub-arch member to said dome compression ring; dome foundation means; means to hingedly secure said lower end of said first sub-arch member to said foundation means; a first pair of spreader means having near and remote ends, said near ends being secured to the midpoint of said first sub-arch member; a second pair of spreader means having near and remote ends, said near ends being secured to the midpoint of said second sub-arch member; said pairs of said spreader means extending normally downwardly and diverging laterally away from said sub-arch members laterally in equal and opposite directions; first cable means connecting said first spreader means remote ends to said first sub-arch member upper and lower ends; second cable means connecting said second spreader means remote ends to said second sub-arch member upper and lower ends; and third cable means connecting said remote ends of said first and second spreader means.

7. The tension chord reinforced arched dome of claim 6, including a plurality of said first and second sub-arch members in radial alignment about said dome compression ring; means to fasten together the remote ends of adjacent spreader means; and dome encircling cable means sequentially connecting the remote ends of said adjacent spreader means.

8. In a tension chord reinforced arched dome including a plurality of pairs of first and second sub-arch members having opposite ends, cable spreader means having remote ends, cable means, a compression ring, circular foundation means, and hinge action type fastening means, the method of assembling and erecting said dome comprising the steps of:

(a) positioning said compression ring at the center of said circular foundation means at foundation level;

(b) connecting said pairs of first and second sub-arch members in abutting alignment with hinge type fastening means at foundation level;

(c) jackknifing said pairs of first and second sub-arch members about said hinge type fastening means until said opposite ends span the foundation level radial distance between said compression ring and said foundation means;

(d) shifting said jackknifed pairs of first and second sub-arch members into vertical planes;

(e) radially aligning said first and second sub-arch members between foundation level compression ring and said circular foundation means;

(f) connecting said pairs of first and second sub-arch members between said foundation level compression ring and said circular foundation means with hinge type fastening means;

(g) securing cable spreader means to the midsections of said first and second sub-arch members;

(h) connecting cable means from the said remote ends of said spreader means to said opposite ends of said first and second sub-arch members;

(i) opening said jackknifed sub-arch means by elevating said compression ring until said connected first and second sub-arch means assume a single arcuate curvature between said elevated compression ring and said circular foundation means;

(j) securing said first and second sub-arch means in their arcuate curvature position; and (k) covering said plurality of first and second sub-arch means with roofing material means.

* * * * *